US005222439A

United States Patent [19]

Di Rosa

[11] Patent Number: 5,222,439

[45] Date of Patent: Jun. 29, 1993

[54] MATERIAL CONVEYANCE SYSTEM USING POWERED TROLLEYS ON A SUSPENDED RAIL

[75] Inventor: Gaetano Di Rosa, Turin, Italy

[73] Assignee: Fata Automation S.p.A., Turin, Italy

[21] Appl. No.: 952,149

[22] Filed: Sep. 28, 1992

Related U.S. Application Data

[63] Continuation of Ser. No. 798,914, Nov. 29, 1991, abandoned.

[30] Foreign Application Priority Data

Nov. 30, 1990 [IT] Italy ..... 22211/90[U]

[51] Int. Cl.[5] ..... B61B 3/00

[52] U.S. Cl. ..... 105/148; 105/150; 105/152; 105/153; 105/156; 104/93

[58] Field of Search ..... 104/89, 93, 118, 246; 105/148, 149, 150, 152, 153, 156

[56] References Cited

U.S. PATENT DOCUMENTS

| | | | |
|---|---|---|---|
| 3,001,634 | 9/1961 | Bauder | 105/156 |
| 3,935,822 | 2/1976 | Kaufmann | 104/93 |
| 4,520,733 | 6/1985 | Willmann | 104/93 |
| 4,644,873 | 2/1987 | Uttscheid | 104/93 |
| 4,860,662 | 8/1989 | Matsumoto et al. | 104/93 |
| 5,069,141 | 12/1991 | Ohara et al. | 104/93 |

FOREIGN PATENT DOCUMENTS

| | | | |
|---|---|---|---|
| 202807 | 5/1985 | Italy . | |
| 21977 | 10/1990 | Italy . | |
| 4-38263 | 2/1992 | Japan | 105/149 |
| 2225996 | 6/1990 | United Kingdom | 104/93 |

*Primary Examiner*—Mark T. Le

*Attorney, Agent, or Firm*—Finnegan, Henderson, Farabow, Garrett & Dunner

[57] ABSTRACT

A conveyor system (10) with a suspended rail (11) on which run trolleys (12) having an upper drive wheel (13) and lower bucking rollers (15,16). The wheel and the rollers are rigidly fixed relative to one another. Each trolley (12) has a geometry such as to cause a rotation moment around the upper wheel (13) when the trolley traverses sloped sections of rail to increase the force of contact or traction of the driving wheel (13) on the rail. The rail (11) has a cross section of variable thickness along its length so that the distance between the wheel and the rollers is uniform on the curves between straight horizontal and sloping sections.

6 Claims, 1 Drawing Sheet

MATERIAL CONVEYANCE SYSTEM USING POWERED TROLLEYS ON A SUSPENDED RAIL

This application is a continuation of application Ser. No. 07/798,914, filed Nov. 29, 1991, now abandoned.

BACKGROUND OF THE INVENTION

In the art of internal transportation in factories, there are often used so called "self-powered" handling systems which consist of a suspended monorail on which run trolleys powered through an electrical distribution line arranged along the monorail. The trolleys usually have a drive wheel placed above the rail and bucking rollers place below it. Traction of the powered upper wheel on the monorail is generally sufficient for level movement and along slight rises. For inclined sections with relatively steep slopes, there have been proposed lower bucking rollers equipped with a spring-loaded system which pushes the rollers toward the rail so as to increase adherence or traction of the drive wheel on the rail as, for example, described in Italian patent n. 202807 in the name of FATA European Group.

The use of pressurized rollers, in addition to being costly, has the drawback of increasing the space occupied by the trolleys, resulting in a greater size for the entire transportation line. In addition, the solution requires a very accurate setting and regulation of the pressures on the rollers to achieve a comprise between ensuring sufficient adherence of the drive wheel along the steeper rises of the path with the maximum load transportable on the one hand without creating excessive generation of stresses on the structure during level running on the other. Even if the optimal compromise is achieved, the pressing rollers, needed to ensure substantially uniform operation and hence supply the necessary friction for running on the steepest rises, when running on level sections or with slight slopes will generate useless stressing of the mechanical parts of the trolley and increase wear of the rolling gear and the rail.

To obviate this last shortcoming there has been proposed, as described in my copending U.S. patent application Ser. No. 800,321, a system of handling using trolleys with a pressing device which is loaded only in the sloping sections as a result of a thickening thereof in relation to the thickness of the rail in the level sections. This solution, while achieving its ends is, however, still encumbered to a certain degree by the cost of the pressing devices and by their complexity of construction and need for adjustment.

Another drawback is that such lower or bucking rollers dependent on elastic pressure means, allow the trolleys to swing in the direction of travel. This swinging is detrimental in the case of transportation systems where operations are to be performed on the loads being carried. For this reason, there are generally used self-powered trolleys capable of independently negotiating sloping sections when processing is to be performed on the loads moving along the line of transportation.

The general object of the present invention is to obviate the above mentioned drawbacks by providing a transportation system of the self-powered type which allows the trolleys to ascend and descend ramps with relatively steep slopes, is of limited size and complexity and free from swinging and in which the thrust of the drive wheel on the rail is substantially a function of the slope being traversed.

SUMMARY OF THE INVENTION

In view of said object, the present invention provides a suspended rail conveyor system for the transportation of loads hung on trolleys each having an upper drive wheel and a plurality of lower bucking rollers running on the upper surface and on the lower surface respectively of the rail, said rail having level sections and sloped sections, characterized in that in combination the upper wheel and the lower rollers which are rigidly connected relative to each other, the wheel, rollers and the point of application of the load bearing on the trolley are mutually arranged so that, when running in sloping sections, the straight line of application of the total weight bearing on the trolley does not pass through the point of contact of the upper wheel, to produce a rotation moment opposed by at least one of said plurality of wheels. The rail has a uniform thickness substantially equal to the distance between the rollers and the wheel in the horizontal straight sections and in sloped straight sections and in curved sections with upward convexity decreasing in thickness in a filleted manner to maintain contact between the rollers and the wheel and the respective surfaces of the rail along said curved sections with minimal play and no interference.

BRIEF DESCRIPTION OF THE DRAWINGS

To further clarify the explanation of the innovative principles of the present invention and its advantages as compared with the known art there is described below with the aid of the drawings an embodiment applying said principles. In the drawings.

DETAILED DESCRIPTION OF THE INVENTION

Figure 1:
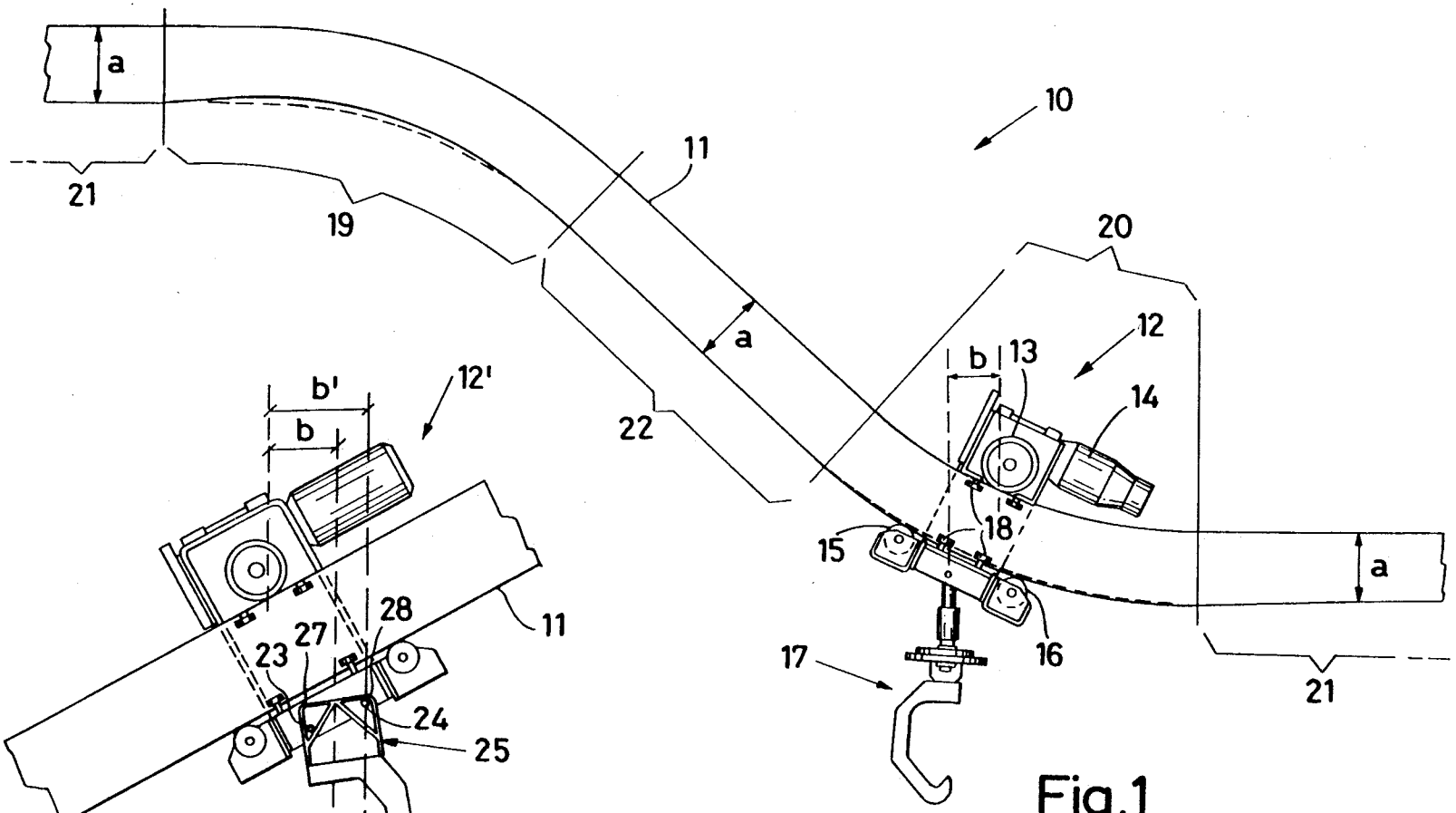
FIG. 1 is a schematic side view of a section of the trolley constructed in accordance with the present invention.

With reference to FIG. 1, there is shown schematically a sloping section of a system constructed in accordance with the present invention, generally indicated by reference number 10, having independently powered trolleys 12 running on a rail 11. The trolleys are substantially identical, only one of which is shown and described below. Each trolley comprises a frame, an upper wheel 13 for drive and support that is kinematically connected to drive means such as an electric motor 14 and a pair of lower bucking or idling rollers 15 and 16. The lower idling rollers and the upper wheel are rotatably mounted on the trolley frame in a fixed relationship at the angles of an imaginary, invariable and substantially isosceles shaped triangle.

Advantageously alongside the trolley, there are also located idling rollers 18 for guiding the trolley along the side profiles of the rail.

Below, the trolley 12 are articulated support means 17 for hanging the transported loads, e.g. automobiles parts along an assembly line.

The point of application of the total load bearing on the trolley and the rollers 15, 16 and the wheel 13 are mutually arranged so that when running in the sloping sections a vertical straight line passing through the center of gravity of the load does not pass through the point of contact of the wheel 13 and rail 11. In particular, and with reference to FIG. 1, the line passes upstream of both the upper wheel 13 and of the lower wheel 16 further downstream. In other words, the line passes to the left of the wheel 13 and the roller 16. Advantageously during level travel, the center of gravity is substantially arranged on the vertical of the upper wheel. The reasons for such arrangements will be given below. In the level sections 21 and sloping straight sections 22 the rail has a uniform thickness "a" equal to the distance between the lower rollers and the upper wheel. In the curved sections with upward convexity, as for example that indicated by reference number 19 in the figure, the rail is reduced in thickness in a filleted manner so as to maintain contact between the rollers and the wheel with the respective surfaces of the rail with minimum play and without the interference which there would be otherwise. The reduced thickness can be obtained simply by milling a normal rail with a standard thickness thinner in that area, the dashed line representing the normal thickness of a rail and the solid line a filleted rail.

Similarly in the curved sections with upward concavity, as for example that indicated by reference number 20 in the figure, the rail is increased in thickness in a filleted manner so as to recover the play which there would otherwise be between the lower rollers and the rail. In this case also the variation in thickness can be obtained starting with a rail with a standard thickness and securing thereto appropriate shimming. Again, the figure shows in dash-de lines a rail of standard thickness and in solid a filleted rail. The exact shape of the rail in accordance with the present invention is easily obtained with trajectories described by the rollers and by the wheel during movement of the trolley along a line representing its path.

In use, when running on the level, the trolley is mere hung by the wheel 13, the rigid geometry of the rollers 15 and 16 with the wheel 13 preventing swinging of the trolley in the direction of travel without any pressure means creating any useless friction as is known in the art.

As stated above, when running on sloping sections, the vertical line of the point of application or force of the weight being transported will no longer pass through the point of contact of the upper wheel. There is thus produced a moment arm "b" which causes the trolley to rotate (e.g. counter-clockwise as shown in the drawing). This moment is opposed by one of the two rollers 15,16 and thus this tends to push the upper wheel 13 harder against the rail 11. With the arrangement shown in the figure, the roller opposing this rotation will be the roller 16, while the roller 15 will have virtually no contact with the rail.

This thrust on the wheel 13 tends to increase adherence thereof proportionately to the load of the trolley. At the same time, the rigid geometry of the relationship between the wheels and the rollers and the form of the rail continue to prevent undesirable swinging of the trolley and also prevents jumping of the trolleys when starting up slopes Because of this arrangement, it has been surprisingly found possible to perform a movement, even with changes in the slope of the rail, without using pressing rollers but, on the contrary, using trolleys with rollers and wheels rigidly interconnected. Running on rises is thus assured with a very simple mechanical embodiment of the trolleys which is small and economical. In addition the trolleys are prevented from any swinging movement in the direction of travel, whether in level or rising travel, allowing operation to be performed on the objects transported at any point of the path even with the trolley moving.

Finally, within ample limits of the weight being carried and the inclination of the rail, the thrust on the drive wheel is practically self-adjusting without generating useless stresses and friction as had happened with embodiments of the prior art.

Naturally the above description of an embodiment applying the innovative principles of the present invention is given merely by way of example and therefore is not to be taken as a limitation of the invention. For example, it is obviously possible to provide, in accordance with the present invention, as readily imaginable by those skilled in the art, multiple trolleys, i.e. made up of two or more trolleys as described above and interconnected by a hinged joint.

In addition, the variations in thickness of the rail, even though indicated as being made on the lower side thereof, can obviously be made on the top.

Naturally, if in the concave sections it is not considered necessary to prevent jumping on restarting of the trolley and swinging during travel it is possible to omit the thickening of the rail.

Finally, the physical structure of the trolleys can be different from that shown. For example, the rollers could be in a number different from that shown; it being sufficient that during ascending travel the straight vertical line passing through the center of gravity of the total weight bearing on the trolley does not pass through the point of contact of the upper wheel and that at least one lower roller is in a position to oppose the moment thus generated in such a manner as to increase the thrust of the wheel 13 on the rail. The point of application of the load transported on the trolley must be selected to supply the arm "b" at least enough to produce the necessary traction of the wheel according to the slope of the rail.

For example, to increase the arm "b" for an equal inclination of the rail, the joint to which the trolley load is hung could be placed at a greater distance downward from the lower rollers.

Figure 2:
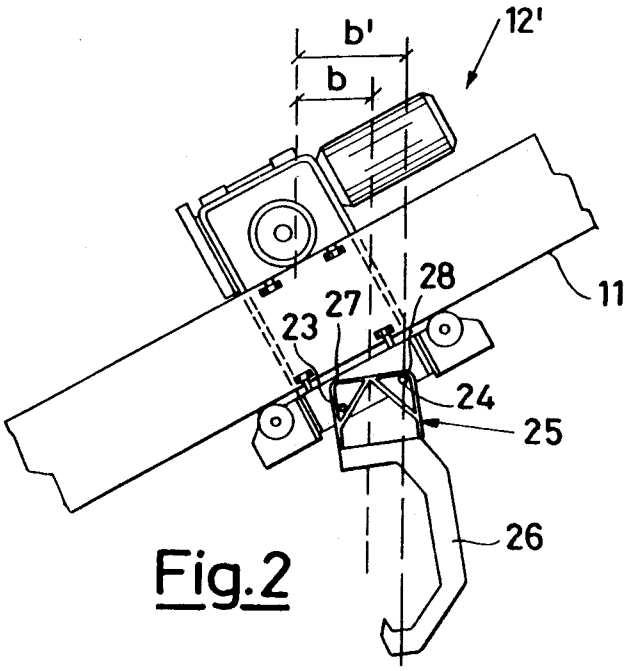
FIG. 2 is a variant of the embodiment of the trolley of FIG. 1.

FIG. 2 shows a construction variantof the trolley which generates a moment arm b' greater than the arm b of FIG. 1 without substantially incrasing the overall vertical dimension of the trolley. In this variant, the trolley 12' (otherwise similar to the trolley 12 of FIG. 1) is equipped at the bottom with two pins 23, 24 respectively arranged in a plane parallel to the rail 11. On the pins 23 and 24 rests a reticulated frame structure 25 having at the bottom thereof a support means 26 for holding the load to be transported. During level travel, the plane containing the pins is horizontal and the inside of the edges 27 and 28 of the reticulated frame structure 25 rests on both pins 23 and 24. In this position, a vertical line passing through the center of gravity of the load, would be substantially on the center line between the two pins.

When travelling on a slope, the weight of the load tends to cause rotation of the reticulated structure around the upper pin so that the center of gravity of the load is now brought onto that pin. In this position, as shown in FIG. 2, the moment arm of rotation o the trolley is b', which is greater than arm b which would be obtained by hanging the load from a center point between the pins as shown in FIG. 1.

It is obvious that if the trolley covers a section with an opposite slope, the pin involved with the load will be the other one with the generation of an opposite moment arm. With the embodiment just described there is obtained the further advantage than when running level the load support is hung from two points and this assures better stability of the load.

I claim:

1. A conveyor system comprising an overhead suspended rail, said rail having straight horizontal rail sections, straight sloping rail sections located between horizontal rail sections at different levels, said straight sections having a constant thickness, and curved rail sections connecting said horizontal rail sections with said sloping rail sections, at least one powered trolley adapted to run along said rail, said trolley having a frame, at least one upper drive wheel rotatably mounted in the frame to run along a top side of the rail, drive means for driving said drive wheel and at least two lower bucking rollers rotatably mounted in said frame and spaced from one another in the direction of travel of the trolley to run along a bottom side of the rail, said wheel and rollers being mounted in the frame in fixed relationship to one another with the point of contact of the drive wheel with the top side of the rail being midway between the points of contact of the rollers with the bottom side of the rail and the distance between said points of contact being substantially equal to the thickness of the straight sections of the rail, two support posts mounted in said frame between said rollers, spaced from each other in the direction of travel of the trolley and on either side of a point midway between the rollers, a support hook having an upper end and a lower end, means on its lower end for holding a load to be transported by said trolley and a frame structure on its upper end adapted to hang from said two support posts, said frame structure hanging from both said posts when the trolley is running along a straight horizontal rail section, so that the plane of application of the force generated by said load being transported on the drive wheel against said rail is perpendicular to the horizontal rail section and passes between the two support posts and through the point of contact of the drive wheel with the rail and said frame structure hanging from only one of said support posts when the trolley is running along a sloping rail section, so that the plane of application of the force generated by said load being transported on said drive wheel passes through said one support post and is offset from the point of contact of the drive wheel with the rail to create a moment arm of force that increases the force on the drive wheel generated by said load in said sloping rail section over that generated by said load in said horizontal rail section.

2. The system of claim 1, wherein the two support posts are in a plane horizontal to the top and bottom sides of the rail and are equally spaced from said midway point, the plane of application of the force generated by said load in the straight rail sections passing midway between said two posts.

3. The system of claim 1, wherein the support posts comprises two parallel pins that extend outwardly from said frame perpendicular to said rail.

4. The system of claim 3, wherein the frame structure of said hook comprise a reticulated structure having a pair of upper edges that rest on said pins.

5. The system of claim 1, wherein the curved rail sections comprise a first curved rail section having a concave top side and convex bottom side located between a sloping rail section and a lower horizontal rail section and a second curved rail section having a convex top side and a concave bottom side located between a sloping rail section and a higher horizontal rail section, said first and second curved rail sections having a thickness that varies gradually in the direction of travel of the trolley, the minimum thickness of the first curved rail section being equal to and the maximum thickness greater than the thickness of the straight rail sections while the maximum thickness of the second curved rail section is equal to and the minimum thickness is less than the thickness of the straight rail sections, so that at least two bucking rollers are always in contact with said rail during travel of the trolley along said curved rail sections.

6. The system of claim 1, wherein the trolley has one upper drive wheel and two lower bucking rollers, said wheel and rollers forming an isosceles triangle with the rollers the base thereof.

* * * * *